US010672582B2

(12) United States Patent
Yoneda et al.

(10) Patent No.: US 10,672,582 B2
(45) **Date of Patent: *Jun. 2, 2020**

(54) ELECTRIC WIRE

(71) Applicant: DEXERIALS CORPORATION, Shinagawa-ku, Tokyo (JP)

(72) Inventors: Yoshihiro Yoneda, Tokyo (JP); Yuji Furuuchi, Tokyo (JP); Kazumasa Sakakibara, Aichi (JP)

(73) Assignee: Dexerials Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/514,051

(22) PCT Filed: Sep. 25, 2015

(86) PCT No.: PCT/JP2015/004881

§ 371 (c)(1),
(2) Date: Mar. 24, 2017

(87) PCT Pub. No.: WO2016/047147

PCT Pub. Date: Mar. 31, 2016

(65) Prior Publication Data

US 2017/0278663 A1 Sep. 28, 2017

(30) Foreign Application Priority Data

Sep. 26, 2014 (JP) ..... 2014-195992

(51) Int. Cl.
*H01H 85/06* (2006.01)
*H01H 85/12* (2006.01)
(Continued)

(52) U.S. Cl.
CPC ..... *H01H 85/12* (2013.01); *H01B 1/02* (2013.01); *H01H 85/0241* (2013.01); *H01H 85/06* (2013.01); *H01H 85/11* (2013.01)

(58) Field of Classification Search
CPC ..... H01H 85/06; H01H 85/08; H01H 85/11; H01H 85/12; H01H 69/02; H01H 85/0241; H01B 1/02
(Continued)

(56) References Cited

U.S. PATENT DOCUMENTS 3,869,689 A * 3/1975 Kasamatu ..... H01H 85/08 337/164
4,134,094 A * 1/1979 Huber ..... H01H 85/46 337/159
(Continued)

FOREIGN PATENT DOCUMENTS

JP S56-20253 U 2/1981
JP S58-122350 U 8/1983
(Continued)

OTHER PUBLICATIONS

Tony Cafe, T.C. Forensic Article 10—Physical Constants for Investigators. Feb. 8, 2003.*
(Continued)

*Primary Examiner* — Jacob R Crum
(74) *Attorney, Agent, or Firm* — K&L Gates LLP

(57) ABSTRACT

It is an object of the invention to provide an electric wire having an excellent electrical conductivity in use of the high melting point metal and being able to surely cut off by fusing the conductive material itself at a temperature lower than the melting point of the high melting point metal, even where heat is generated from flowing overcurrent in the electrical circuit. The electric wire of the invention has a feature including a conductive material formed of a first conductive member made of a low melting point metal, and a second conductive member made of a high melting point metal, which are provided adjacent to each other, wherein the conductive material is fused by erosion of the high melting
(Continued)

point metal according to melting of the low melting point metal.

12 Claims, 5 Drawing Sheets

(51) Int. Cl.
*H01B 1/02* (2006.01)
*H01H 85/02* (2006.01)
*H01H 85/11* (2006.01)

(58) Field of Classification Search
USPC ..... 337/293
See application file for complete search history.

(56) References Cited

U.S. PATENT DOCUMENTS

| | | | | |
|---|---|---|---|---|
| 4,320,374 | A * | 3/1982 | Narancic | H01H 85/06 337/162 |
| 5,099,218 | A * | 3/1992 | Salisbury | H01H 85/055 337/160 |
| 5,304,740 | A * | 4/1994 | Bozell | H01B 3/441 174/110 PM |
| 2002/0109574 | A1* | 8/2002 | Handcock | H01H 85/055 337/292 |
| 2006/0268645 | A1* | 11/2006 | Graf | H01H 37/761 365/225.7 |
| 2010/0176910 | A1* | 7/2010 | Knab | H01H 37/761 337/290 |
| 2013/0234822 | A1* | 9/2013 | Aurich | B22D 41/015 337/416 |
| 2015/0162772 | A1* | 6/2015 | Peterson | H02J 7/0031 320/135 |

FOREIGN PATENT DOCUMENTS

| | | | |
|---|---|---|---|
| JP | 63-235368 | | 9/1988 |
| JP | H01-315925 | A | 12/1989 |
| JP | H08-111163 | A | 4/1996 |
| JP | 2013-037929 | A | 2/2013 |
| JP | 2014-022172 | | 2/2014 |
| JP | 2014-063639 | | 4/2014 |

OTHER PUBLICATIONS

International Search Report (with English translation) dated Nov. 10, 2015 in corresponding international application No. PCT/JP2015/004881 (7 pages).
Written Opinion dated Nov. 10, 2015 in corresponding international application No. PCT/JP2015/004881 (4 pages).
Korean Office Action dated Aug. 22, 2018 in corresponding Korean Application No. 10-2017-7006080.
Korean Office Action dated Feb. 6, 2018 in corresponding Korean Application No. 10-2017-7006080.
Chinese Office Action dated Dec. 19, 2018 in corresponding Chinese Application No. 2015800481945.
Korean Office Action dated Sep. 16, 2019 in corresponding Korean Application No. 10-2017-7006080.
Chinese Office Action dated May 17, 2019 in corresponding Chinese Application No. 201580048194.5.
Korean Office Action dated Jan. 16, 2020 in corresponding Korean Application No. 10-2017-7006080.
Korean Office Action dated Mar. 12, 20020 in corresponding Korean Application No. 10-2017-7006080.

* cited by examiner

ELECTRIC WIRE

CROSS-REFERENCE TO RELATED APPLICATIONS

The present application claims the benefit of International Application No. PCT/JP2015/004881, filed Sep. 25, 2015, which claims priority to Japanese Application No. 2014-195992, filed Sep. 26, 2014, the disclosures of which are incorporated herein by reference.

FIELD OF THE INVENTION

This invention relates to an electric wire having a fuse function cutting off an electric circuit by fusing a conductive member where heat is generated or extraordinary surged heat occurs at its periphery due to flow of extraordinary current (or overcurrent) in the electric circuit.

BACKGROUND OF RELATED ART

Generally, wires used for wiring electric circuits use structures such as a wire 200 as shown in FIG. 5(*a*), in which a metal element line (single line) 50 made of a linear shape conductive metal material is covered with an insulation covering material 60, and such as a wire 201 as shown in FIG. 5(*b*), in which plural metal element lines 51 are bundled and covered with a covering material 60 at the periphery of the lines. High melting point metals such as copper are used for those metal element lines in view to such as lowness of electrical resistance rate, material costs, and easiness of availability. The copper, however, has a high melting point of 1085 degrees Celsius, and where heat is generated due to overcurrent flow through an electric circuit, the covering material may catch fire before current supply is cut off by fusing the copper line.

To prevent the electric wire from accidentally catching fire due to overcurrent, a flame retardant cover material is used these days to correspond this matter, but an ordinarily available resin based covering material has a limitation in terms of heat resistibility.

In meantime, Patent Document #1 discloses an electric wire having an overcurrent cutoff function made of a metal whose melting point is equal to or less than 700 degrees Celsius, in lieu of a fusible link electric wire as an electric wire having a function equivalent to a fuse.

PRIOR TECHNICAL DOCUMENTS

Patent Document #1: Japanese Patent Application Publication No. 2014-63639

SUMMARY OF THE INVENTION

The art disclosed in Patent Document #1 suppresses damages given to the covering material and the peripheral circuit by making smaller the generated heat amount at a time of fusing due to overcurrent with use of the metal having the melting point of 700 degrees Celsius or less. Where such a metal is used as a conductor, however, there arises a problem of high electric resistance as the electric wire.

In consideration of the problems described above, it is an object of the invention to provide an electric wire using a high melting point metal with a melting point of 900 degrees Celsius or greater to be excellent on electric conductivity and having an overcurrent cutoff function capable of cutting off a current supply by fusing action at a temperature lower than a melting point of the high melting point metal, even where heat is generated due to overcurrent flow through an electric circuit.

Means to Solve the Problems

To solve the above problems, the electric wire according to an embodiment of the invention has a feature that including a conductive material formed of a first conductive member made of a low melting point metal, and a second conductive member made of a high melting point metal, which are provided adjacent to each other, wherein the conductive material is fused by erosion of the high melting point metal according to melting of the low melting point metal.

Advantages of the Invention

According to the invention, it is able to provide an electric wire using a high melting point metal to be excellent on electric conductivity and having an overcurrent cutoff function capable of cutting off a current supply by fusing the conductive member itself at a temperature lower than a melting point of the high melting point metal, even where heat is generated due to overcurrent flow through an electric circuit.

EMBODIMENTS FOR WORKING THE INVENTION

Hereinafter, embodiments for working the invention are described in referring the drawings. It is to be noted that the invention is not limited to the following description and can be modified as far as not deviated from the subject matter of the invention.

First, an electric wire according to one embodiment of the invention is described. The electric wire according to the invention has a feature including a conductive material formed of a first conductive member made of a low melting point metal, and a second conductive member made of a high melting point metal, which are provided adjacent to each other, wherein the conductive material is fused by erosion of the high melting point metal according to melting of the low melting point metal. In this invention, the conductive member itself including the high melting point metal is fused at a temperature around a melting point of the low melting point metal to cut off a current supply by utilizing a phenomenon of "erosion" in which the high melting point metal in a solid state is melt down with the low melting point metal in a melting state. Details are described as follows.

Figure 1A:
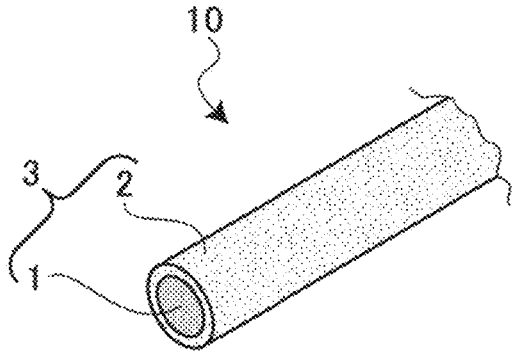
FIGS. 1 (*a*) to 1(*f*) are schematic diagrams showing structural examples of electric wires according to embodiments (a) to (f) of the invention.
Figure 1B:
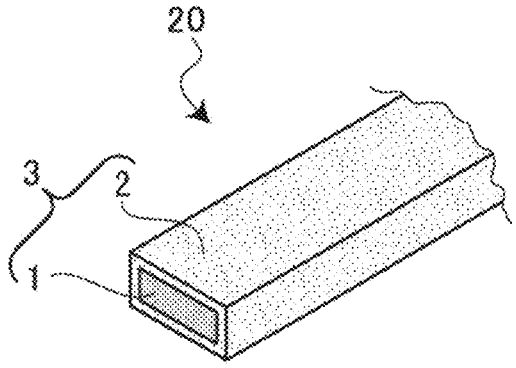
Figure 1C:
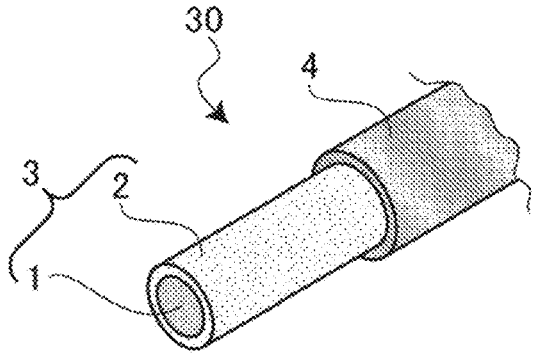
Figure 1D:
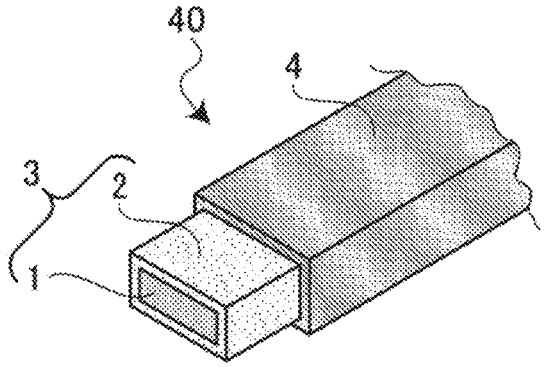
Figure 1E:
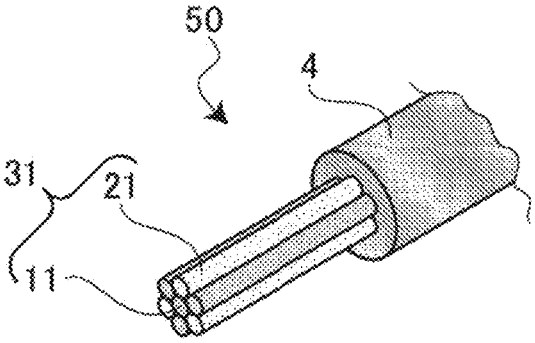
Figure 1F:
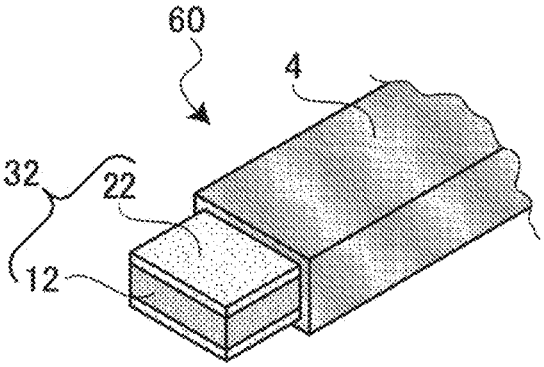

FIGS. 1(*a*) to 1(*f*) are schematic diagrams showing structural examples of electric wires according to the embodiments of the invention.

FIG. 1(*a*) is a diagram showing an embodiment of an electric wire having conductive materials in which a surface of a metal element line made of a low melting point metal as the first conductive member is covered with a high melting point metal as the second conductive member.

As shown in FIG. 1(*a*), the electric wire 10 has a conductive material 3 in which the surface of the metal element line 1 made of a low melting point metal formed with a circle cross section extending in a radial direction is formed with a metal layer 2 by a plating process of a high melting point metal.

As low melting point metals for this invention, metal materials have a melting point of 300 degrees Celsius or less, preferably of 260 degrees Celsius or less; for example, tin, and alloys including tin as the main component such as solder (or namely tin-lead alloy), tin-copper alloy, tin-bismuth alloy, and tin-silver alloy, can be used. The metal element line 1 having a prescribed cross-sectional area can be obtained by processing those metal materials such as rolling, wire drawing, and annealing with respect to those metal materials.

The cross section of the metal element line 1 made of the low melting point metal, can be chosen properly so that fusing operation can be done at a prescribed current value (overcurrent value). The total volume of the metal element line 1 per unit length is set to be larger than the total volume of the metal layer 2 per unit length. It is preferable to adjust the volume of the metal element line 1 with respect to the total volume of the conductive member 3 per unit length to be 50% or greater.

As the high melting point metal for this invention, used are metal materials having a melting point of 900 degrees Celsius or greater, preferably 960 degrees Celsius or greater; for example, such as silver, copper, steel, alloy containing silver as a main component, alloy containing copper as a main component, alloy containing steel as a main component, tin plate, and corrugated galvanized steel, can be used. The metal layer 2 made of any of those metal materials can be formed on the surface of the metal element line 1 by plating such as, e.g., dissolved plating, gas phase plating, electric plating, and chemical plating. It is preferable to set the volume of the metal layer 2 with respect to the total volume of the conductive member 3 per unit length to be 20% or less, and the volume can be set properly for showing a prescribed electrical conductivity as an electric wire.

The electric wire 10 shown in FIG. 1(*a*), enjoys highly contacting characteristics between the low melting point metal as the first conductive member and the high melting point metal as the second conductive member, because the surface of the metal element line 1 made of the low melting point metal is covered directly with plating of the metal layer 2 made of the high melting point metal. The electric wire 10 also has excellent mechanical strength in concurrently having a prescribed electrical conductivity as the electrical wire. According to the electric wire 10, even where heat is generated as overcurrent flows in the electrical circuit, the conductive material 3 is fused by itself at a temperature, i.e., about 300 to 400 degrees Celsius, which is lower than the melting point of the high melting point metal, thereby surely cutting off the electrical supply. It is to be noted that, in an example shown in FIG. 1(*a*), the embodiment having the structure that the cross-sectional shape in the radial direction of the metal element line 1 is circle, but the electric wire of the invention can be structured of, as shown in FIG. 1(*b*), e.g., an electric wire 20 in a ribbon shape having a rectangular cross section of the metal element line 1.

FIG. 1(*c*) is a diagram showing an embodiment in which an insulation material covers a conductive member in which a surface of the metal electric line made of a low melting point metal as the first conductive member is covered with a high melting point metal as the second conductive member.

As shown in FIG. 1(*c*), the electric wire 30 includes the conductive material 3 in which the surface of the metal electric line 1 made of a low melting point metal as the first conductive member is covered with a high melting point metal, and an insulation material 4 covering the conductive material 3.

The electric wire 30 shown in FIG. 1(*c*) has a structure in which an outer peripheral surface of the electric wire 10 illustrated using FIG. 1(*a*), namely the outer peripheral surface of the metal layer 2 made of a high melting point metal, is covered with the insulation material 4. The iginition point or fire catching point of the insulation material 4 is set to be a temperature higher than the melting point of the metal element line 1 made of the low melting point metal. With this structure, even where heat is generated from overcurrent flowing in the electrical circuit, the conductive material 3 itself is fused before the insulation material 4 catches fire, thereby surely cutting off the current supply, so that the electric wire 30 can prevent beforehand any firing accident from occurring in accompany with catching fire at the insulation material 4.

As the materials of the insulation material 4, employed are insulation organic polymer compositions, namely insulation organic polymers made of insulation resins blended with various additives such as, e.g., flame retardants, crosslinking agents, and antioxidants, and the insulation material layer serving as the insulation material 4 can be formed by extruding or coating those materials to the outer peripheral surface of the conductive material 3. As the insulation resins, exemplified are, e.g., polypropylene, polyvinyl chloride, polyvinylidene chloride, polytetrafluoroethylene, polystyrene, styrene-acrylonitrile copolymer, styrene-methyl methacrylate copolymer, polymethacrylic acid methyl, cellulose acetate, polyamide, phenole resin, melamine resin, silicone resin, and unsaturated polyester. Those insulation resins can be used solely or in combination of plural resins. In addition to the above, the nature of the insulation material 4 is preferably a material subject to thermal deformation at a temperature lower than the melting point of the metal element line 1 made of the low melting point metal, in consideration of structural changes (deformation or cutoff) of the conductive material due to erosion and circumstances such as confirmation of existence of fusion by visibility. In other words, from thermal deformation of the insulation material 4, occurrences of an extraordinary state can be recognized from the appearance. It is to be noted that in the example shown in FIG. 1(*c*), the structure in which the cross section in the radial direction of the metal element line 1 is circle is described, and for example, as shown in FIG. 1(*d*), the electric wire according to the invention can be structured as a ribbon shaped electric wire 40 formed with the metal element line 1 having a cross section in a rectangular shape.

FIG. 1(*e*) is a diagram showing a feature of a conductive material structured of several number of metal element lines made of the low melting point metal as the first conductive member and several number of metal element lines made of the high melting point metal as the second conductive member, which are twisted to each other, and covered with an insulation material.

As shown in FIG. 1(*e*), an electric wire 50 includes a conductive material 31 structured from several number of the metal element lines 11 made of the low melting point metal having a circle cross section in the radial direction and from several number of the metal element lines 21 made of the high melting point metal having the circle cross section in the radial direction as well, which are twisted to each other, and the insulation material 4 covering the conductive material 31.

As the metal element line or lines 11 made of the low melting point metal, in substantially the same manner as the metal element line 1 as shown in FIG. 1(*a*), exemplified are metal materials having the melting point of 300 degrees Celsius or less, preferably 260 degrees Celsius or less, for example, tin and alloys including tin as a main component such as, e.g., solder (or namely tin-lead alloy), tin-copper alloy, tin-bismuth alloy, and tin-silver alloy. The metal element line 11 having a prescribed cross-sectional area can be obtained by rolling, wire drawing, and annealing with respect to those metal materials.

The cross-sectional area of the metal element lines 11 made of the low melting point metal can be set properly so as to be fused with a prescribed current value (overcurrent value) where several lines of the metal element lines are twisted. The total area per unit length of the metal element lines 11 is set to be larger than the total area per unit length of the metal element lines 21. It is preferable to adjust the volume of the metal element lines 11 with respect to the total volume per unit length of the conductive material 31 to be 50% or greater.

As the metal element line or lines 21 made of the high melting point metal, in substantially the same manner as the metal element line 1 as shown in FIG. 1(*a*), usable are metal materials having the melting point of 900 degrees Celsius or greater, preferably 960 degrees Celsius or greater, for example, silver, copper, steel, alloy containing silver as a main component, alloy containing copper as a main component, alloy containing steel as a main component, tin plate, and corrugated galvanized steel. The metal element lines 21 having a prescribed cross-sectional area can be obtained by rolling, wire drawing, and annealing with respect to those metal materials. It is further preferable to adjust the volume of the metal element lines 21 with respect to the total volume per unit length of the conductive material 31 to be 20% or less, and it can be set properly for rendering the electric wire indicate a prescribed electric conductivity.

In the example of the electric wire 50 shown in FIG. 1(*e*), a preferable volume ratio with respect to the total volume per unit length of the conductive material 31 described above can be set by adjusting the respective line numbers of the metal element lines 11 and the metal element lines 21 to be twisted. The insulation material 4 made of an insulation organic polymer component or components in substantially the same as the electric wire 31 as shown in FIG. 1(*c*), covers the outer periphery of the conductive material 31 thus structured, thereby obtaining the electric wire 50.

There are gaps between the element lines of the conductive material 31 structured of the metal element lines 11 and the metal element lines 21, which are twisted to each other, so that the conductive material 31 is in a state apparently having a large volume. With this state, if the metal element line is melt, a moving range of the low melting point metal in the melting state becomes wide. Consequently, the low melting point metal can diffuse onto the high melting point metal in a wide range, so that the erosion phenomenon can be further promoted.

It is to be noted that in the example of the electric wire 50 as shown in FIG. 1(*e*), though the structure bundling each metal element line is described in a straight state where the metal element lines are made adjacent to each other as a structure for twisting the metal element lines 11 and the metal element lines 21, the wire is not limited to this structure, and can be a structure in which the metal element lines are braided to each other by, such as, e.g., tangling the metal element lines 11, 21 from successively laterally (or obliquely) winding the metal element line or lines 21 with respect to the metal element line or lines 11, or tangling the metal element lines 11, 21 from successively laterally (or obliquely) winding the metal element line or lines 11 with respect to the metal element line or lines 21.

FIG. 1(*f*) is a diagram showing a structure in which an insulation material covers a conductive material structured of overlapped layers of a layer body made of a low melting point metal as the first conductive member and a layer body made of a high melting point metal as the second conductive member.

As shown in FIG. 1(*f*), an electric wire 60 includes a conductive material 32 formed of a layer body 12 made of a low melting point metal in which a cross section is structured as a rectangular shape and two layer bodies 22 made of a high melting point metal in which a cross section is structured as a rectangular shape in the substantially the same way, and an insulation material 4 covering the conductive material 32.

As the layer body 12 made of the low melting point metal, metal materials substantially the same as the metal element line 1 shown in FIG. 1(*a*) to FIG. 1(*e*) can be used, and the layer body 12 having a prescribed cross section can be obtained by treating such as, e.g., rolling processing to those metal materials.

As the cross section of the layer body 12 made of the low melting point metal, the cross section can be set properly so that fusion can be done at a prescribed current value (overcurrent value). The total volume per unit length of the layer body 12 can be set more than the total volume per unit length of the layer body 22. It is preferable to adjust the volume of the layer body 12 to be 50% or greater with respect to the total volume per unit length of the conductive material 32.

As the layer body 22 made of the high melting point metal, metal materials substantially the same as the metal layer 2 shown in FIG. 1(*a*) to FIG. 1(*e*) can be used, and the layer body 22 having a prescribed cross section can be obtained by treating such as, e.g., rolling processing to those metal materials. It is to be noted that it is preferable to adjust the volume of the layer body 22 to be 20% or less with respect to the total volume per unit length of the conductive material 32, and that the volume can be set properly for showing a prescribed electric conductivity as the electric wire.

In the example of the electric wire 60 shown in FIG. 1(*f*), a preferable volume ratio with respect to the total volume per unit length of the conductive material 32 described above can be set by adjusting the respective layer numbers of the layer bodies 12 and the layer bodies 22 to be overlapped. As an overlapping method for the layer bodies 22 to the layer bodies 12, exemplified are, e.g., pressingly coupling method, brazing melting coupling method, and so-called soldering method. For example, if the layer body 12 made of the low melting point metal is structured of a solder, brazing in use of the solder made of the same metal material as the layer body 22 to be coupled with the layer body 22 made of the high melting point metal can be used, so that the costs relating to overlapping of the layer bodies can be suppressed, and so that purity of products can be made higher because the metal materials to be used are much less. The insulation material 4 made of an insulation organic polymer composition, which is substantially the same as the electric wire 30 as shown in FIG. 1(*c*), is made to cover the outer periphery of the outer periphery of the conductive material 32 thus formed, thereby obtaining the electric wire 60.

Because the surface of the layer body 12 made of the low melting point metal is coupled (or overlapped) with the two layer bodies 22 made of the high melting point metal in the electric wire 60 shown in FIG. 1(*f*), adhesion between the low melting point metal as the first conductive member and the high melting point metal as the second conductive member is made higher, and therefore, the electric wire 60 is excellent on mechanical strength as well as having a prescribed electric conductivity as the electric wire. According to the electric wire 10, even where heat is generated from flowing overcurrent in the electrical circuit, the conductive material 32 itself is fused at a temperature lower than the melting point of the high melting point, so that the current supply is surely cut off.

In the examples shown in FIG. 1(*a*) to FIG. 1(*f*), particularly, the examples shown in FIG. 1(*a*) to FIG. 1(*f*), although the structure that the second conductive member made of the high melting point metal covers the surrounding of the first conductive member made of the low melting point metal, this invention is not limited to this, and a structure that the first conductive member made of the low melting point metal covers the surrounding of the second conductive member made of the high melting point metal may be used. For example, if referring to the example of the electric wire 10 shown in FIG. 1(*a*), a structure can be used in which the metal element line 1 as the second conductive member made of the high melting point metal is covered with plating of the metal layer 2 as the first conductive member made of the low melting point metal. In this situation, by making finer the metal element line 1 as well as by making thicker the layer thickness of the metal layer 2, a preferred volume ratio can be formed with respect to the total volume per unit length of the conductive material described above.

Figure 2A:
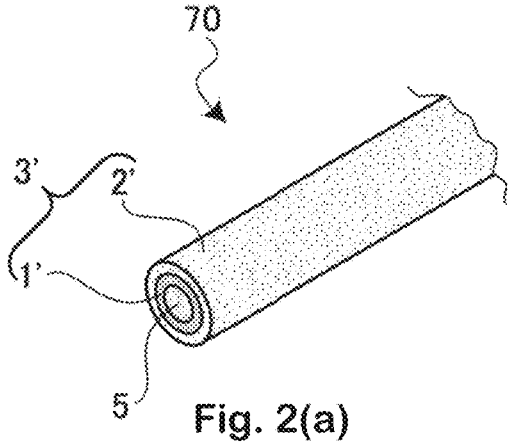
FIGS. 2(*a*) to 2(*f*) are other schematic diagrams showing structural examples of electric wires according to embodiments (a) to (f) of the invention.
Figure 2B:
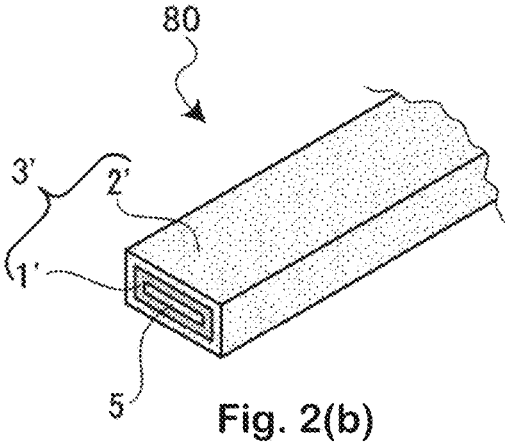
Figure 2C:
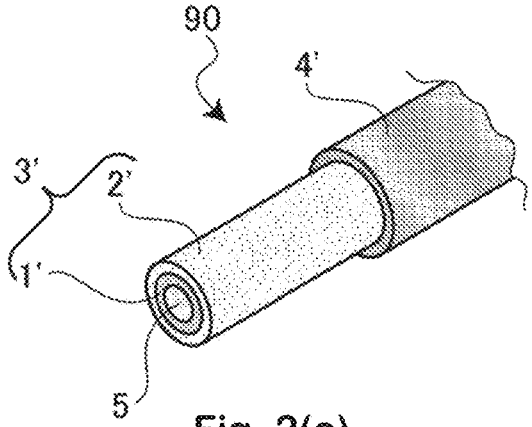
Figure 2D:
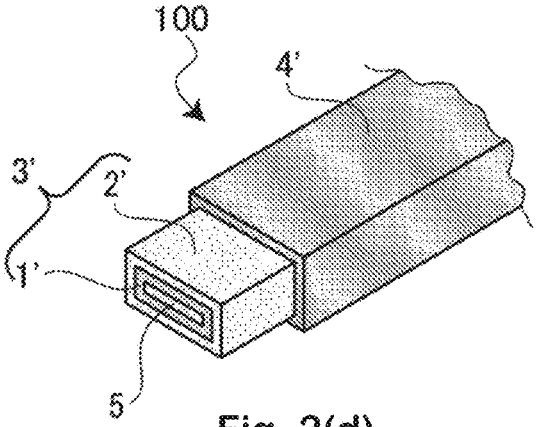
Figure 2E:
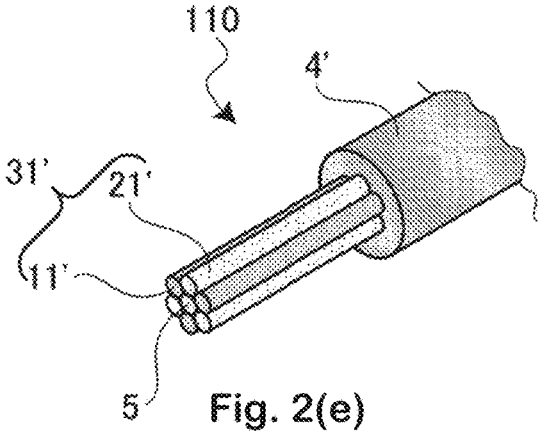
Figure 2F:
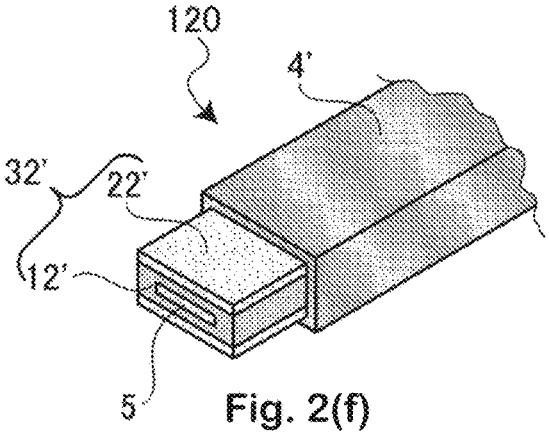

FIG. 2(*a*) to FIG. 2(*f*) are diagrams describing structural examples of the electric wires according to other embodiments of the invention. It is to be noted that such as, e.g., the low melting point metal, the high melting point metal, and the insulation organic polymer composition can be formed of the same respective materials as those of the electric wires 10 to 60 shown in FIG. 1(*a*) to FIG. 1(*f*).

An electric wire 70 shown in FIG. 2(*a*) includes a conductive material 3' in which a surface of the metal element line 1' made of the low melting point metal structured with a circle cross-sectional shape in the radial direction is formed with a metal layer 2' by plating-processing of the high melting point metal, and a flux 5 formed in a shape of a fine line at a center portion in the metal element line 1'.

The flux 5 according to this invention indicates a material such as, e.g., pine resin for removing chemically oxide films on the metal surfaces, and can prompt diffusion of the low melting point metal in a melting state. According to the electric wire 70 holding the flux 5 inside the conductive material 3', even where heat is generated from flowing overcurrent in the electrical circuit, erosion is prompted by diffusing the low melting point metal on the high melting point metal with good efficiency, so that the current supply is surely cut off by fusing the conductive material 3' itself at a temperature lower than the melting point of the high melting point. Because the surface of the metal element line 1' made of the low melting point metal is directly covered with plating of the metal layer 2' made of the high melting point metal in substantially the same manner as the electric wire 10 shown in FIG. 1(*a*), the adhesion between the low melting point metal as the first conductive member and the high melting point metal as the second conductive member is made higher, and the electric wire is excellent on mechanical strength as well as having a prescribed electric conductivity as the electric wire. It is to be noted that in the example shown in FIG. 2(*a*), although the structure that the metal element line 1' has a circle cross section in the radial direction is described, the electric wire according to the invention as shown in FIG. 2(*b*) can be structured in having the flux 5 inside the metal element line 1', and can be formed as an electric wire 80 in a ribbon shape having a rectangular cross section.

An electric wire 90 shown in FIG. 2(*c*) includes a conductive material 3' in which a surface of the metal element line 1' made of the low melting point metal structured with a circle cross-sectional shape in the radial direction is formed with a metal layer 2' by plating-processing of the high melting point metal, an insulation material 4' covering the conductive material 3', and a flux 5 formed in a shape of a fine line inside the conductive material 3', or namely at a center portion in the metal element line 1'.

According to the electric wire 90 holding the flux 5 inside the conductive material 3', even where heat is generated from flowing overcurrent in the electrical circuit, erosion is prompted by diffusing the low melting point metal on the high melting point metal with good efficiency, so that the current supply is surely cut off by fusing the conductive material 3' itself at a temperature lower than the melting point of the high melting point. The electric wire 90 has a structure that the outer periphery of the conductive material 3', or namely the outer periphery of the metal layer 2' made of the high melting point metal is covered with the insulation material 4' in substantially the same manner as the electric wire 30 shown in FIG. 1(*c*), and the ignition point of the insulation material 4' is a higher temperature than the melting point of the metal element line 1' made of the low melting point metal. Accordingly, even where heat is generated from flowing overcurrent in the electrical circuit, the current supply is surely cut off by fusing the conductive material 3' itself before the insulation material 4' catches fire, so that any fire accident will be prevented beforehand from occurring in accompany with catching fire or ignition at the insulation material 4'. It is to be noted that in the example shown in FIG. 2(*c*), although the structure that the metal element line 1' has a circle cross section in the radial direction, the electric wire according to the invention as shown in FIG. 2(*d*), can be formed of an electric wire 100 in a ribbon shape having a structure that the flux 5 is provided inside the metal element line 1' and that the cross-sectional shape is rectangular.

An electric wire 110 shown in FIG. 2(*e*) includes a conductive material 31' structured of the metal element lines 11' made of the low melting point metal structured with a circle cross section in the radial direction and the metal element lines 21' made of the high melting point metal structured with a circle cross section in the radial direction in the same manner, which are twisted to each other by several number of the lines, an insulation member 4' covering the conductive member 31', and a flux 5 formed in a shape of a fine line inside the conductive material 31', or namely at a center portion twisted of the metal element line 11' and the metal element line 21'.

According to the electric wire 110 holding the flux 5 inside the conductive material 31', even where heat is generated from flowing overcurrent in the electrical circuit, erosion is prompted by diffusing the low melting point metal on the high melting point metal with good efficiency, in addition to a structural effect of the electric wire 50 shown in FIG. 1(*e*), so that the current supply is surely cut off by fusing the conductive material 3' itself at a temperature lower than the melting point of the high melting point metal.

An electric wire 120 shown in FIG. 2(*f*) includes a conductive material 32' structured of the layer body 12' made of the low melting point metal structured with a rectangular cross section and the layer body 22' made of the high melting point metal structured with a rectangular cross section in the same manner, an insulation member 4' covering the conductive member 32', and a layered shaped flux 5 formed in a shape of layers inside the conductive material 32', or namely at a center portion of the layer body 12'.

According to the electric wire 120 holding the flux 5 inside the conductive material 32', even where heat is generated from flowing overcurrent in the electrical circuit, erosion is prompted by diffusing the low melting point metal on the high melting point metal with good efficiency, so that the current supply is surely cut off by fusing the conductive material 32' itself at a temperature lower than the melting point of the high melting point metal. In substantially the same manner as the electric wire 60 as shown in FIG. 1(*f*), because the surface of the layer body 12' made of the low melting point metal is coupled (or overlapped) with the two layer bodies 22' made of the high melting point metal, the adhesion between the low melting point metal as the first conductive member and the high melting point metal as the second melting point metal is made higher, and therefore, the electric wire 120 is excellent on mechanical strength as well as having a prescribed electric conductivity as the electric wire.

It is to be noted that in the examples shown in FIG. 2(*a*) to FIG. 2(*f*), the structures that the flux is provided at the center portion of the metal element lines or layer bodies made of the low melting point metal, but this invention is not limited to this, and for example, if the example of the electric wire 70 shown in FIG. 2(*a*) is described, flux may be provided between the metal element line 1' and the metal element line 2', and the flux may cover the outer periphery of the metal layer 2'.

Figure 3A:
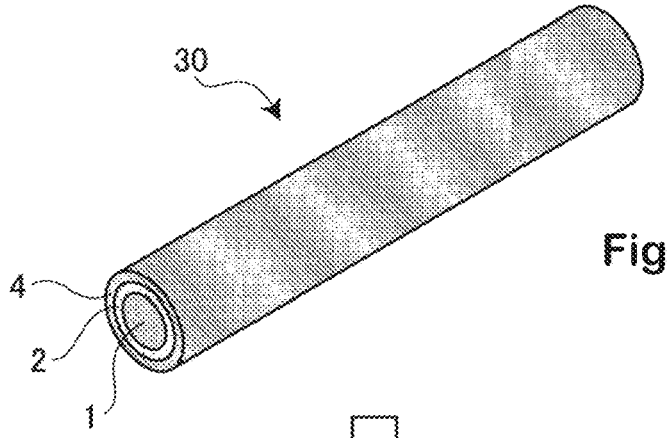
FIGS. 3(*a*) to 3(*d*) are state transition diagrams illustrating a fusing process of the electric wire according to the embodiment of the invention.
Figure 3B:
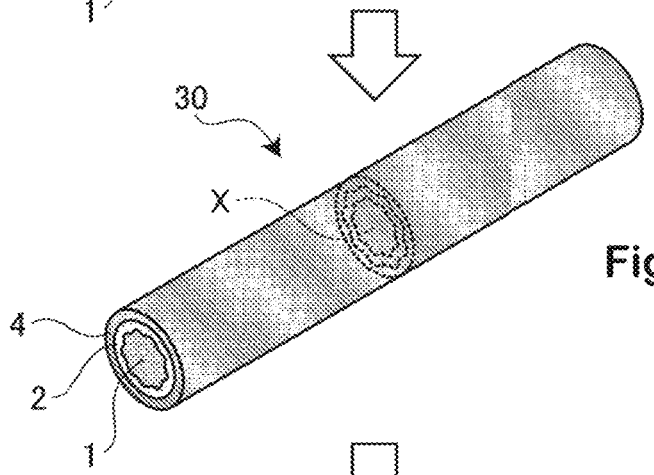
Figure 3C:
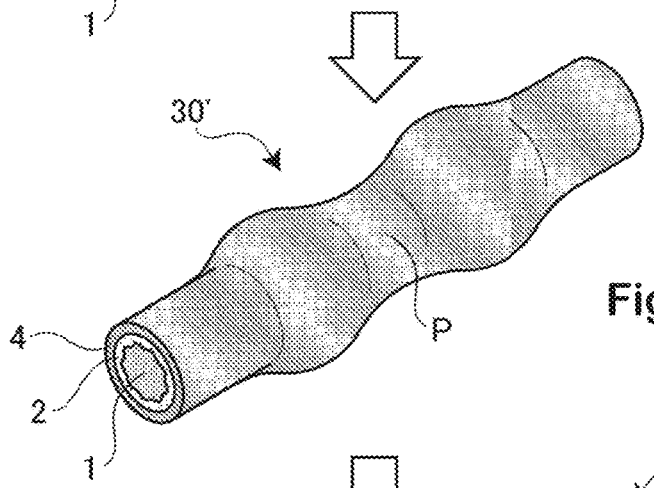
Figure 3D:
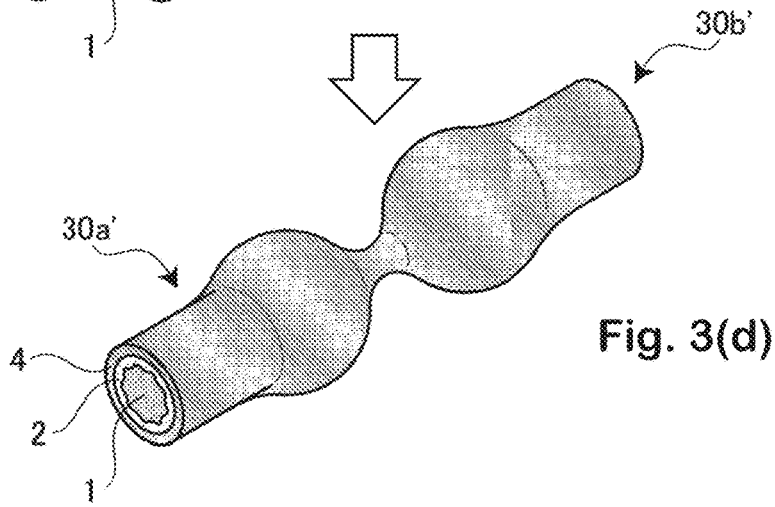

FIG. 3 are state transition diagrams illustrating a fusing process of the electric wire according to the embodiment of the invention. In this description, the electric wire 30 illustrated in FIG. 1(*c*) is described as the example.

First, as shown in FIG. 3(*a*), heat is generated from flowing overcurrent in the electrical circuit, not shown, connected to each of the opposite ends of the electric wire 30, if the heated temperature exceeds the melting point of the metal element line 1 made of the low melting point metal, the metal element line 1 begins to solve itself and cannot maintain the original shape of the electric wire.

Then, erosion action proceeds by diffusing the low melting point metal X in a melting state on the metal layer 2 made of the high melting point metal. In accordance with the erosion action, the metal layer 2 made of the high melting point metal begins to melt.

As shown in FIG. 3(*c*), according to proceeding of the erosion action, the formation of the insulation material 4 begins thermally deforming, and where the thickness near the fusion point P becomes thinner, the electric wire 30' becomes shrunk as having a diameter smaller than the original diameter.

Finally, the electric wire 30' is fused at the fusion point P, the ends of the insulation material 4 on the side of the fusion point P cover the lump shaped electric wires 30*a'*, 30*b'* (FIG. 3(*d*)).

As described above, according to the electric wires of the embodiments, even where heat is generated from flowing overcurrent in the electrical circuit, the current supply is surely cut off by fusing the conductive material itself at a temperature lower than the melting point of the high melting point metal. The electric wire end separated at the fusion point never be reunited, so that power may not be supplied erroneously after the fusion of the wire. Where the periphery installing this electric wire is heated at or above a temperature of the melting point of the low melting point metal, the current supply is surely cut off by fusing the conductive material itself at a temperature lower than the melting point of the high melting point metal in substantially the same manner.

Figure 4A:
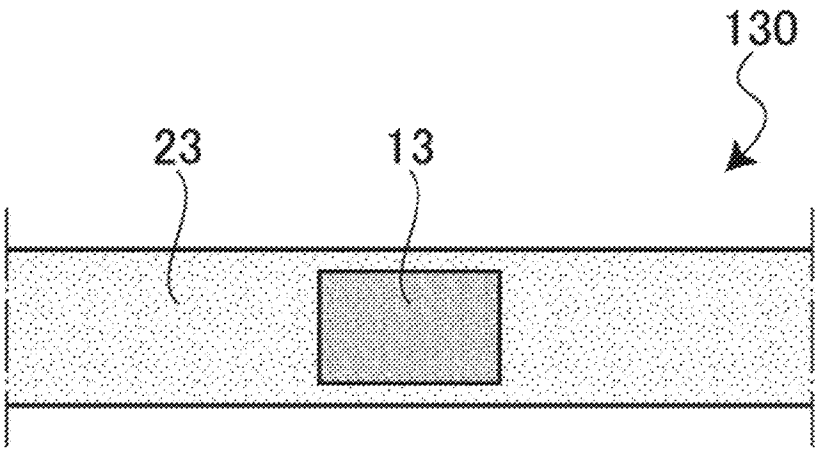
FIGS. 4(*a*) to 4(*d*) are schematic diagrams showing modified structural examples of electric wires according to embodiments (a) to (d) of the invention.
Figure 4B:
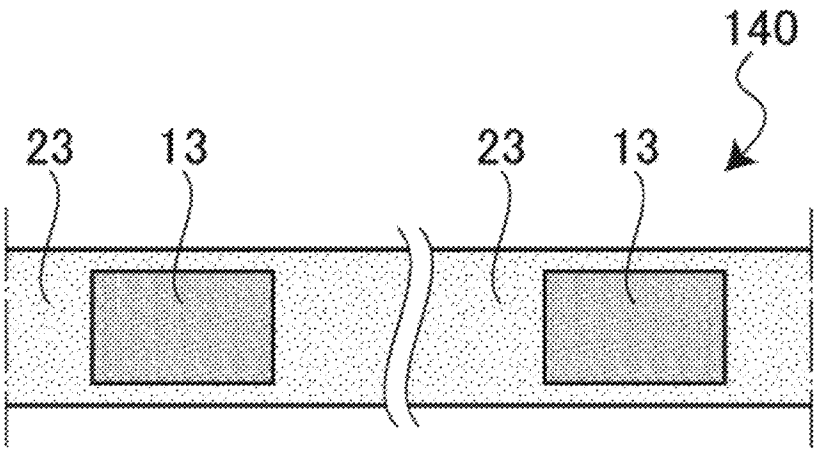
Figure 4C:
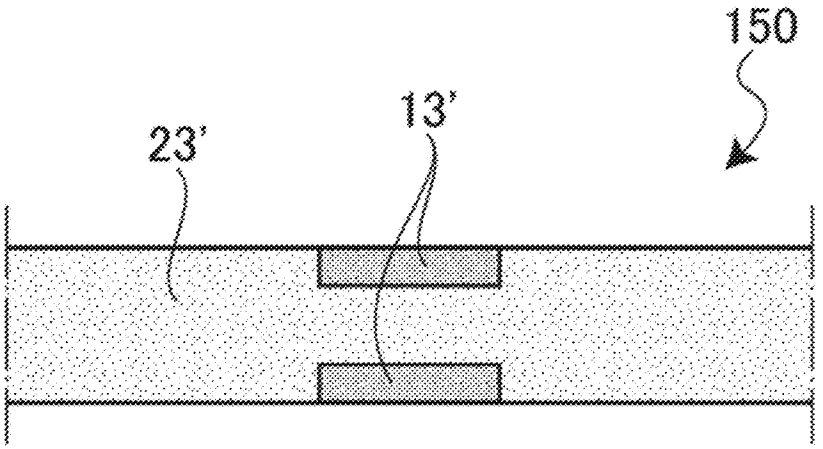
Figure 4D:
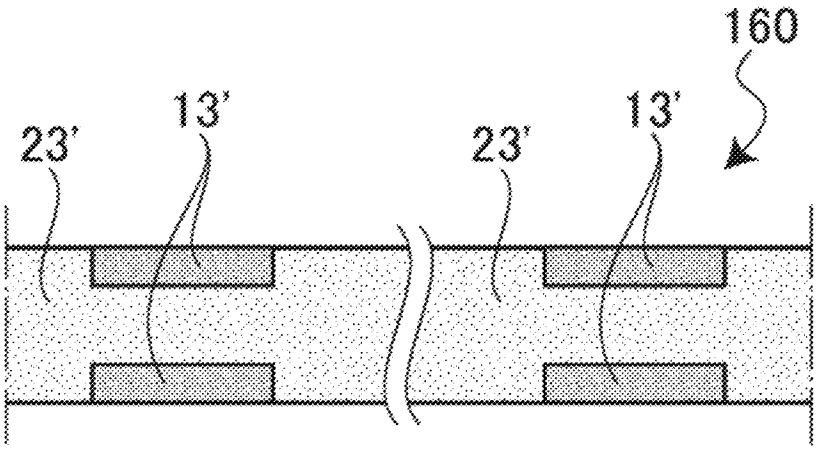
Figure 5A:
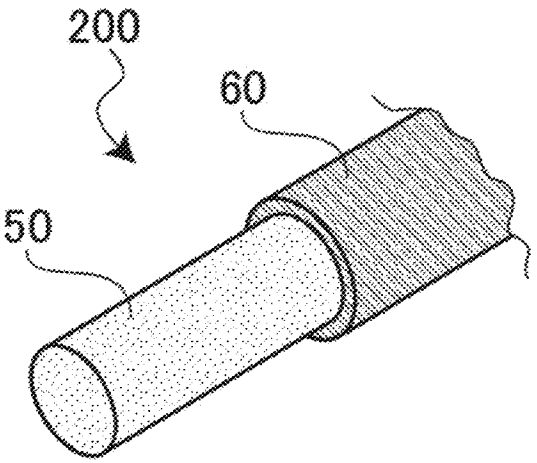
FIGS. 5(*a*), 5(*b*) are schematic diagrams showing a prior art.
Figure 5B:
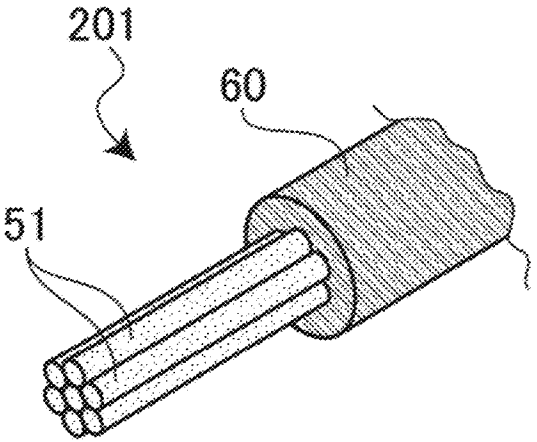

FIG. 4 are schematic diagrams illustrating a modified example of the electric wire according to an embodiment of the invention, and are diagrams as cross sections extending in a longitudinal direction of the electric wire. The electric wires shown in FIG. 1 and FIG. 2 are examples in which the portion having the low melting point metal is formed across the whole length of the electric wire. In the modified example shown in FIG. 4, described is a structure in which the portion having the low melting point metal is formed partly to the whole length of the electric wire.

An electric wire 130 shown in FIG. 4(*a*), is an example that a conductive portion 13 made of the low melting point metal is formed partly near the axial center of the metal element line 23 made of the high melting point metal formed along the whole length of the electric wire, and an electric wire 140 shown in FIG. 4(*c*), is an example that a conductive portion 13' made of the low melting point metal is formed outside in the radial direction of the metal element line 23' made of the high melting point metal formed along the whole length of the electric wire. In this example, because the conductive material is structured of the first conductive member (or the conductive portions 13, 13') made of the low melting point metal and the second conductive member (or the metal element lines 23, 23'), which are adjacent to each other, even where heat is generated from flowing overcurrent in the electrical circuit, the current supply is surely cut off by fusing the conductive material itself at a temperature lower than the melting point of the high melting point metal. According to this modified example, because the conductive portions 13, 13' made of the low melting point metal are partly formed with respect to the metal element lines 23, 23' made of the high melting point metal, an advantage that the fused portion can be detected easily from viewing to the appearance of the electric wire, is obtainable. It is to be noted that the conductive portions 13, 13' can be provided at plural locations with respect to the metal element lines 23, 23', and there is no limit to the installation number (FIGS. 4(*b*), 4(*d*)).

In FIGS. 1(*c*), 1(*d*), 1(*f*), and FIG. 2(*c*), 2(*d*), 2(*f*), the insulation material covers the single number of the conductive material, but the electric wire can be structured such that the insulation material covers the plural conductive material, which is bundled or twisted, in accordance with a prescribed permitted current of the electric wire.

As described above, according to the invention, the electric wire can be provided in having an excellent electrical conductivity in use of the high melting point metal and in being able to surely cut off by fusing the conductive material itself at a temperature lower than the melting point of the high melting point metal, even where heat is generated from flowing overcurrent in the electrical circuit.

DESCRIPTION OF REFERENCE NUMBERS

1, 1', 11, 11', 21, 21', 23, 23' Metal Element Line
2, 2' Metal Layer
3, 3', 31, 31', 32, 32' Conductive Material
4, 4' Insulation Material
5 Flux
12, 12', 22, 22' Layer Body
13, 13' Conductive Portion
10, 20, 30, 40, 50, 60, 70, 80, 90, 100, 11, 120, 130, 140, 150, 160 Electric Wire

What is claimed is:

1. An electric wire used for wiring electric circuits, the electric wire having a fuse function, comprising: a conductive material formed of a second conductive member made of a high melting point metal, which coats a surface of a first conductive member made of a low melting point metal, wherein the coated high melting point metal has a working effect for improving a mechanical strength of the conductive material and the coated high melting point metal is silver or alloy containing silver as a main component, the conductive material is fused by erosion of the high melting point metal according to melting of the low melting point metal, and a volume of the high melting point metal with respect to a total volume per unit length of the conductive material is 20% or less, and a melting point of the low melting point metal is lower than 260 degrees Celsius, and a melting point of the high melting point metal is equal to or greater than 900 degrees Celsius, and the conductive material is fused by itself at a fusing temperature from 300 to 400 degrees Celsius, and the fusing temperature of the conductive material is lower than a melting point of the high melting point metal.

2. An electric wire used for wiring electric circuits, the electric wire having a fuse function, comprising a conductive material formed of a second conductive member made of a high melting point metal, which laminates a surface of a first conductive member made of a low melting point metal, wherein the laminated high melting point metal having a working effect for improving a mechanical strength of the conductive material and the laminated high melting point metal is silver or alloy containing silver as a main component, the conductive material is fused by erosion of the high melting point metal according to melting of the low melting point metal, and a volume of the high melting point metal with respect to a total volume per unit length of the conductive material is 20% or less, and a melting point of the low melting point metal is lower than 260 degrees Celsius, and a melting point of the high melting point metal is equal to or greater than 900 degrees Celsius, and the conductive material is fused by itself at a fusing temperature from 300 to 400 degrees Celsius, and the fusing temperature of the conductive material is lower than a melting point of the high melting point metal.

3. The electric wire according to claim 1, wherein a melting point of the second conductive member is equal to or greater than 960 degrees Celsius.

4. The electric wire according to claim 1, further comprising an insulation member covering one or more of the conductive materials, wherein the ignition temperature of the insulation member is higher than the melting point of the low melting point metal.

5. The electric wire according to claim 1, wherein the low melting point metal is tin or alloy mainly containing tin.

6. The electric wire according to claim 1, wherein the wire contains inside a flux.

7. The electric wire according to claim 1, wherein an area of the low melting point metal is broader than an area of the high melting point metal in at least one cross section perpendicular to a current flowing direction.

8. The electric wire according to claim 4, wherein the insulation member is subject to thermal deformation at a temperature lower than the melting point of the first conductive member made of the low melting point metal.

9. A fuse element used for wiring electric circuits, the fuse element having a fuse function, comprising: a conductive material formed of a second conductive member made of a high melting point metal, which coats a surface of a first conductive member made of a low melting point metal, wherein the coated high melting point metal has a working effect for improving a mechanical strength of the conductive material and the coated high melting point metal is silver or alloy containing silver as a main component, the conductive material is fused by erosion of the high melting point metal according to melting of the low melting point metal, and a volume of the high melting point metal with respect to a total volume per unit length of the conductive material is 20% or less, and a melting point of the low melting point metal is lower than 260 degrees Celsius, and a melting point of the high melting point metal is equal to or greater than 900 degrees Celsius, and the conductive material is fused by itself at a fusing temperature from 300 to 400 degrees Celsius, and the fusing temperature of the conductive material is lower than a melting point of the high melting point metal.

10. An fuse element used for wiring electric circuits, the fuse element having a fuse function, comprising a conductive material formed of a second conductive member made of a high melting point metal, which laminates a surface of a first conductive member made of a low melting point metal, wherein the laminated high melting point metal having a working effect for improving a mechanical strength of the conductive material and the laminated high melting point metal is silver or alloy containing silver as a main component, the conductive material is fused by erosion of the high melting point metal according to melting of the low melting point metal, and a volume of the high melting point metal with respect to a total volume per unit length of the conductive material is 20% or less, and a melting point of the low melting point metal is lower than 260 degrees Celsius, and a melting point of the high melting point metal is equal to or greater than 900 degrees Celsius, and the conductive material is fused by itself at a fusing temperature from 300 to 400 degrees Celsius, and the fusing temperature of the conductive material is lower than a melting point of the high melting point metal.

11. The fuse element according to claim 10, wherein the first conductive member is structured in ribbon shape.

12. The electric wire according to claim 1, wherein the surface of the first conductive member made of the low melting point metal is covered directly with plating of the second conductive member made of the high melting point metal.

* * * * *